United States Patent [19]

Adams et al.

[11] 4,198,456

[45] Apr. 15, 1980

[54] MULTI-LEVEL EMBOSSED CELLULAR SURFACE COVERING AND PROCESS FOR PRODUCING SAME

[75] Inventors: Kim M. Adams, Lititz; Martin Dees, Jr., Lancaster; Richard P. Mazzur, Millersville, all of Pa.

[73] Assignee: Armstrong Cork Company, Lancaster, Pa.

[21] Appl. No.: 926,039

[22] Filed: Jul. 19, 1978

[51] Int. Cl.[2] ..... B32B 3/26; B05D 5/00

[52] U.S. Cl. ..... 428/159; 427/198; 427/244; 427/270; 427/276; 427/373; 428/161; 428/195; 428/203; 428/285; 428/304; 428/315

[58] Field of Search ..... 264/DIG. 82, 52, 48; 427/244, 198, 264, 270, 276, 373; 428/159, 161, 195, 203, 285, 304, 315

[56] References Cited

U.S. PATENT DOCUMENTS

| | | | |
|---|---|---|---|
| 3,453,171 | 7/1969 | Crowley | 264/52 X |
| 3,490,985 | 1/1970 | Marzocchi et al. | 427/373 X |
| 3,968,275 | 7/1976 | Dees, Jr. et al. | 427/270 |
| 4,068,030 | 1/1978 | Witman | 428/159 |
| 4,090,007 | 5/1978 | Crowley | 427/373 X |

*Primary Examiner*—Evan K. Lawrence

[57] ABSTRACT

The process for making a cellular surface covering having a multi-level embossed decorative wear surface by applying to a porous substrate a plurality of thermoplastic resinous inks developed from thermoplastic binders having different molecular weights and therefore different melt viscosities, the inks and substrate comprising a composite structure which also includes a blowing agent. The blowing agent may be either in the substrate or in the inks applied thereto. Upon final heating to fuse and foam all the resinous material of this structure, the metal viscosity differences of the resins in the inks provide varying degrees of physical resistance to expansion of the total system in the inked areas, thus producing multi-level design areas on the final product.

28 Claims, 7 Drawing Figures

MULTI-LEVEL EMBOSSED CELLULAR SURFACE COVERING AND PROCESS FOR PRODUCING SAME

FIELD OF THE INVENTION

The invention relates generally to a process for producing resinous composition surface coverings and, more particularly, to a process for forming such a product having a multi-level embossed wear surface wherein multiple inks evolved from vinyl resins having distinguishable differences in their melt viscosities or thermoplasticities are printed on a porous substrate to create a design which may extend through at least 5% of the thickness of the layer and can extend through up to 100% thereof. The inks and the substrate comprise a composite structure which also includes a blowing agent. Final heating to fuse the resins and decompose the blowing agent results in a multi-level embossed wear surface because of the varying degrees of physical restriction of foaming of the sheet due to the melt viscosity differences of the resins used in the inks.

DESCRIPTION OF THE PRIOR ART

It is known to enhance the appearance of plastic floor and wall coverings by means of various decorative designs thereon which may extend partially or entirely through the sheet. Further enhancement of the appearance of such sheets has been accomplished by achieving a three-dimensional appearance thereon. Prior methods of doing this have included mechanical or chemical embossing techniques or inclusion with the granules of a dryblend base layer, for example, an ingredient which can be subsequently removed or altered to produce an embossed effect. It is also known to obtain a textured surface on a resinous surface covering by controlling the fluid viscosity of the printing composition used thereon. The use of foamable inks for this purpose is also old. It is further known to inhibit foaming in selected areas of a foamable resinous sheet by chemically increasing the viscosity of the resinous material in those areas. It is also known to produce an embossed surface covering by using two or more resins having different molecular weights (different melt viscosities) to form the particles which, after being pressed into a sheet, recover to varying heights.

U.S. Pat. No. 3,359,352—Powell et al. relates to a method for forming a resinous composition surface covering having a geometric decoration. This is accomplished by depositing a layer of fine granules of resinous composition on the surface of the base, heating to sinter the granules and form a porous layer, printing a design on the sintered layer with a printing composition which will penetrate into the porous composition and then, by heat with or without pressure, forming the printed porous layer into a non-porous layer containing an inlaid design. It is further disclosed by this patent that a textured or embossed product can be obtained by including with the granules a substance which, on further treatment, will create voids in the granular layer. Controlling the amount of printing composition to fill such voids controls the location and depth of the embossing. It is stated in this patent that one way to control the depth of penetration of the printing composition into a sintered dryblend base is by control of the fluid viscosity of the printing composition. Thus, a textured surface may be obtained on the sheet by allowing greater quantities of the printing composition to remain on the surface.

U.S. Pat. No. 3,000,754—Zentmyer relates to a surface covering having a multi-level embossed wear surface. The surface covering is formed by applying to a backing particles of two or more polymerized vinyl chloride resins in which the different resins possess a sufficient spread of molecular weights to result in an embossed appearance of the product solely by virtue of the different stress relaxation characteristics of the resins. After the resin particles are hot pressed, the particles of a higher molecular weight resin recover in a vertical direction to an elevation higher than those of a lower molecular weight. This results in a multi-level embossed wear surface on the sheet.

U.S. Pat. No. 3,365,353—Witman relates to chemical embossing of foamed decorative surface covering. In the process of this invention, a foamable resinous plastisol containing a polymerizable monomer is formed into a sheet. There is then applied to the sheet in a predetermined pattern a composition comprising a liquid that will penetrate the sheet and a catalyst that will cause polymerization of said monomer at a temperature in the range above the glass transition temperature of the plasticized vinyl resin and below the decomposition temperature of said resin. The sheet is then heated to a temperature in the range of about 300°-400° F. to fuse the plasticized resin, decompose the blowing agent, and polymerize the monomer. In this process the viscosity of the resinous material in the printed areas of the resinous foamable substrate is increased in situ by producing, through a chemical reaction, a higher viscosity resinous material in the treated areas.

Another process wherein a chemical reaction is utilized to inhibit or prevent expansion of a plastic material in designated areas of a foamable resinous sheet is disclosed in U.S. Pat. No. 3,453,171—Crowley. In this process, the foregoing is accomplished without regard to the absence or presence of any activators or other additives which alter the decomposition temperature or activation of the blowing agent. The hardening or modifying agent may be applied to a porous sheet of calendered plasticized vinyl chloride particles and allowed to penetrate. Another method for producing a chemically embossed surface covering is disclosed in U.S. Pat. No. 3,671,283—Crowley wherein a vinyl chloride resin plastisol containing a blowing agent is formed into a thin layer on a supporting material and heated to a temperature below the decomposition temperature of the blowing agent to form a gelled layer therefrom. There is then printed onto the smooth, gelled plastisol surface an aqueous latex composition which contains from about 20%-60% of a vinyl chloride resin. It is stated in the patent that the printing composition is allowed to penetrate the gelled layer to the desired degree, after which the gelled layer is heated to fuse the vinyl chloride resin and decompose the blowing agent and to volatize the water employed in the latex composition in the areas to which it was applied. Full expansion of the sheet material is prevented by the increase in resin content in the treated areas, thereby producing a chemically embossed product. The liquid compositions particularly suitable for use in the invention include aqueous latices containing a polymer which has reduced thermal plasticity characteristics over the surface polymer to which it is being applied, such as having a slightly different structural composition or a higher molecular weight so as to reduce the melt viscosity of the treated areas at the temperature of expansion of the treated surface. For example, in the treatment of a gelled poly(vinyl chloride) surface, it is preferred that the polymer be composed of a vinyl chloride copolymer having the reduced thermoplasticity from the poly(vinyl chloride).

In contrast to the processes of the prior art, the process of this invention overcomes problems associated with prior attempts to produce a decorative, multi-level embossed surface on a resinous sheet. In a process where foamable inks were printed side-by-side (butt-printed), many times out-of-register printing resulted in an overblown condition at overlapping printed portions thereof and/or depressed portions (dimples) where the out-of-register printing left areas where no ink was applied. Further, in prior processes wherein foamable dryblend was printed with non-foamable inks, all printed areas of the finished sheet were the same height. Prior attempts to vary the elevation of the printed portions included varying the penetration of the ink and/or the fluid viscosity thereof, or by overprinting. The process of the present invention also provides a simple and effective solution to these problems. In still further contrast to prior processes, the process of this invention does not require alteration or treatment of the substrate material; the amount of expansion in the printed areas can be easily regulated; and the process is not limited to the use of resinous or granular substrates since almost any printable porous substrate may be used.

It can thus be seen that the process of this invention provides a relatively simple and inexpensive procedure for producing a highly decorative embossed wear surface on a resinous surface covering without the need for prior mechanical or chemical embossing equipment and techniques.

SUMMARY OF THE INVENTION

This invention relates to a process for producing a cellular resinous surface covering having a multi-level, embossed decorative wear surface and the product produced by the process. In the process, the expansion of foamable plastic material in the system is restricted in particularly designated areas through the use of multiple inks with thermoplastic binders having different molecular weights and therefore different melt viscosities. This is accomplished without the use of any special additives or activators in the sheet which alter the decomposition temperature of or activate the blowing agent.

There are three embodiments of the invention. In the first embodiment, a layer of foamable dryblend is formed and then heated at a temperature below the decomposition temperature of the blowing agent in the dryblend to form a porous, cohesive layer. The sheet so formed is then printed on in a design with inks developed from vinyl resins having distinguishable differences in their melt viscosities. The printed sheet is then heated to fuse the resinous material and decompose the blowing agent. Due to the melt viscosity differences of the binders in the inks, physical restriction of foaming in selected areas of the sheet is achieved in varying degrees, thus resulting in an embossed, in-register design on the wear surface in a simple and economical manner. Prior to the final heating step, a clear plastisol coat may be applied over the printed foamable base layer for enhanced beauty and durability of the wear surface.

In the second embodiment of the invention, a mechanically frothed poly(vinyl chloride) foam is used as the porous base layer. The mechanically frothed foam, including a blowing agent, was cast onto a paper backing, cooled, and printed with the previously mentioned inks having different melt viscosities. As in the previous embodiment, prior to the final heating step, a clear plastisol coat may be applied over the printed foamable base layer for enhanced beauty and durability of the wear surface. Again, due to the melt viscosity differences of the binders in the ink, physical retardation of the foaming in selected areas of the sheet was achieved in varying degrees. This results in an embossed, in-register design on the wear surface of the finished product.

In the third embodiment of the invention, a porous, reinforced, non-woven polyester web of the type disclosed in U.S. Pat. No. 3,968,275 was used as the printable base layer. In this embodiment, the blowing agent was incorporated into each ink printed thereon. After heating to gel the inks, a clear plastisol top coat was applied and the structure heated to fuse the resin of the structure and decompose the blowing agent. Again, the difference in the melt viscosities of the inks produced a multi-level embossing surface on the structure.

The foregoing process eliminates the need for special equipment and complicated procedures required by the prior art and results in a well-defined, in-register, three-dimensional decorative wear surface on the surface covering with no overblown or depressed out-of-register design areas. The degree of expansion in the printed areas is easily controlled through selection of inks of the desired thermoplasticity which have a varying propensity for limiting expansion of the foamable resinous material.

DESCRIPTION OF THE PREFERRED EMBODIMENTS

Figure 1:
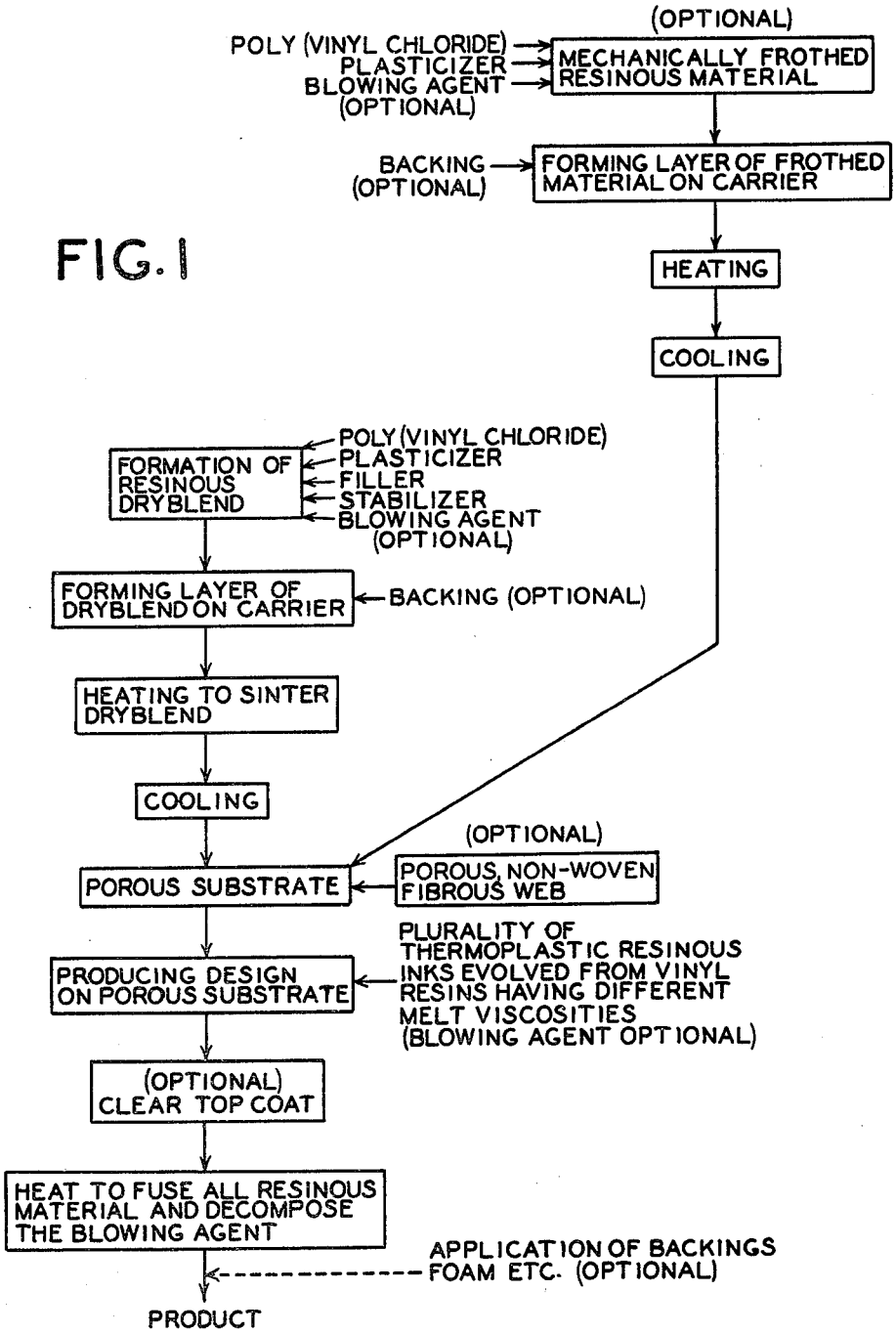
FIG. 1 is a flow diagram depicting the steps followed in carrying out three embodiments of the process of this invention.

This invention is usable with substantially any porous substrate into which the inks applied thereto can penetrate. As indicated by the flow diagram of FIG. 1, there are three embodiments of the invention.

In the first embodiment of the invention, the manufacturing process begins with the formation of a porous substrate. The formation of the porous substrate begins with the formation of a resinous dry-blend. The dry-blend is in the form of a free-flowing homogeneous mixture of unfused thermoplastic resin particles, including liquid vinyl plasticizer, filler, pigment, and vinyl stabilizer. If desired, a blowing agent may be included in the dryblend. However, it will be noted that in this invention the blowing agent may be included in the dryblend or in the inks applied thereto. In this embodiment, as described, the blowing agent is in the dryblend.

Poly(vinyl chloride) is the preferred resin for use in forming the surface covering of the present invention, although copolymers of vinyl chloride with minor proportions of other materials such as vinyl acetate, vinylidene chloride, other vinyl esters such as vinyl proprionate, vinyl butyrate, as well as alkyl substituted vinyl esters may be used.

The free-flowing mix of resin, plasticizer, blowing agent, stabilizer, pigment, and filler may be readily formed by adding the resin, for example, a homopolyer of vinyl chloride, in the form of discrete particles, along with the vinyl resin plasticizer such as di(2-ethyl hexyl)phthalate, butyl benzyl phthalate, expoxidized soybean oil, or tricresyl phosphate, blowing agent, filler, pigment, and suitable vinyl resin stabilizers to a mixer or blender such as a Henschel blender where they are mixed under moderate heat, for instance at a temperature of about 160°-220° F., for a period of time to ensure that the liquid plasticizer and the stabilizer become absorbed and thus diffused throughout the resin particles and the blowing agent and the remaining ingredients adsorbed thereon. Care is taken so that no decomposition of the blowing agent and no fusion of the resin particles occurs during the mixing, and the temperature must be kept below that at which such would occur.

The blowing agent must be thoroughly distributed throughout the resin-plasticizer mixture. A variety of blowing agents is available on the market for incorporation in thermoplastic resins. The preferred blowing agent for poly(vinyl chloride) is azodicarbonamide which normally decomposes at a temperature of about 390° F. in air. This blowing agent is particularly suitable for use in the method of the present invention in view of its relatively high decomposition temperature. Other usable blowing agents with the temperature at which they release gas vigorously in dioctyl phthalate are p,p'-Oxybis (benzenesulfonylhydrazide)—320° F. and p,p'-Oxybis (benzenesulfonylsemicarbazide)—425° F.

As a general rule, the preferred minimum decomposition temperature of a blowing agent should be about 300° F., and the blowing agent should decompose below the decomposition temperature of the resin, which in the case of poly(vinyl chloride) would be about 400° F. However, stabilized vinyl resin composition will normally not decompose until even higher temperatures—approaching 450° F.—are reached.

Generally speaking, the addition of fillers and pigments to the mix may be made either initially, at the end of the mixing cycle when the resin particles remain relatively warm, or after the dryblended resin particles have been mixed and cooled. The color of the layers may be controlled over a wide range and substantially transparent or translucent layers may be achieved by omitting the filler and most or all of the pigment from the vinyl dryblend forming the layer. Based on 100 parts by weight of resin, 15 to 80 parts by weight plasticizer, 1 to 5 parts by weight stabilizer, 0 to 10 parts by weight pigment, and 0 to 200 parts by weight filler may be used in forming the free-flowing mixture.

Figure 2:
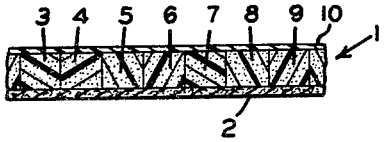
FIG. 2 is a cross-sectional view of a portion of the surface covering being formed by the first embodiment of the process of this invention wherein the inks printed thereon to create the design have penetrated into the porous dryblend and a clear resinous top coat has been applied.

As shown in FIG. 2 of the drawings, a foamable layer of unfused thermoplastic granules 1 of dryblend is then formed on a backing 2. The foamable layer may alternatively be formed on a strippable carrier which may be a steel belt, a rubber belt, paper, or a felt having a release coating thereon. If a permanent carrier is used, it may comprise any of the backings normally used as a floor covering backing such as a beater saturated rubber-asbestos sheet, resin-bonded glass webs, bonded synthetic webs, and asphalt-saturated felts. These carriers may be the only final backing or they may be supplemented with other cushioning materials, such as foams and non-woven material.

The next step in the process involves heating the dryblend layer 1 in the range of from about 280°-350° F. to cause partial melting of the resin granules at their points of contact, thereby forming bonds which result in the formation of a cohesive porous layer having a thickness in the range of from about 15 mils to 100 mils. Bonding of the resinous granules at their points of contact may be effected either by sintering or through activation of a suitable external adhesive coating which may be applied in the final steps of granulation.

After cooling the sintered dryblend layer 1, the next step in the process involves producing a design on the foamable cohesive porous dryblend layer by applying thereto a plurality of inks developed from vinyl resins having distinguishably different melt viscosities, in sufficient amounts to permit penetration thereof into the porous layer to at least about 5% of the thickness thereof. Preferably, as shown in FIG. 2, ink-containing portions, 3, 4, 5, 6, 7, 8, and 9 extend substantially clear through the thickness of the dryblend layer 1. The melt viscosity of all of the plastisols from which the inks are developed must be in the range of 100,000 poise to 3,000,000 poise at 380° F. Optionally, about a 10 mil thickness of a clear resinous top coat 10 may be applied.

In this invention, the limits of the molecular weights of usable resins as determined by Gel Permeation Chromatography are in the range of 50,000 Mw-200,000 Mw.

The present invention turns on the use of inks developed from two or more polymerized vinyl resins in which the different resins possess a sufficient spread of molecular weights and, therefore, melt viscosities, to offer varying degrees of resistance to expansion of the dryblend and plastisol composition in the areas printed with these inks when the sheet is finally heated to fuse the resins and decompose the blowing agent to result in a multi-level embossed appearance on the wear surface of the product.

In reality, the degree of difference is embossed depth depends on: (1) the spread between the difference in melt viscosities, (2) the thickness of the base layer, (3) the penetration of the inks into the base layer, (4) the amount (%) of blowing agent used, and (5) the nature of the base layer. It is preferred that when a thermoplastic base layer is used, the melt viscosity of the base layer corresponds to that of the lowest ink.

It has been found that the molecular weight of the separate resins used in the inks should vary by at least about 7,000 Mw if the embossed appearance is to be distinguishable. At the same time, all the resins used in the inks should have molecular weights falling within the above-stated range of 50,000–200,000 Mw. Thus, the requisite molecular weights are completely defined.

Figure 3:
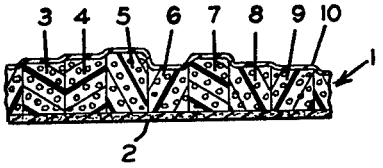
FIG. 3 is a cross-sectional view showing a portion of the surface covering made by the process of this invention from the structure shown in FIG. 2.

FIG. 3 illustrates an enlarged cross section of th product formed after application of the clear top coat 10 and final heating to fuse the resin and decompose the blowing agent. As shown in FIG. 3, in the finished product, ink-containing design elements 3, 4, 5, 6, 7, 8, and 9 are expanded to different elevations because of the varying degrees of physical resistance to expansion provided by the varying melt viscosities of the resins from which the inks were evolved. Design elements 3, 4, 5, 6, 7, 8, and 9, of course, may be of any desired color.

Figure 4:
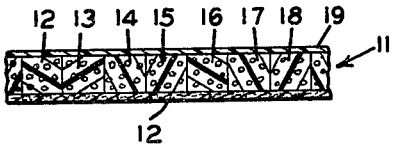
FIG. 4 is a cross-sectional view of a portion of the surface covering being formed by the second embodiment of this invention, showing a paper backing, a mechanically frothed resinous material thereon, resinous inks printed on and extending through the thickness of the foamed material which contains a blowing agent, and a resinous top coat.
Figure 5:
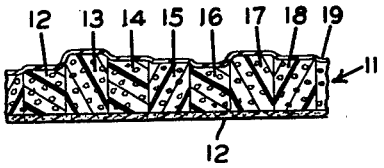
FIG. 5 is a cross-sectional view illustrating a portion of the surface covering by the process of this invention from the structure shown in FIG. 4.

Optionally, as shown in FIGS. 1 and 4, a mechanically frothed resinous material formed in a known manner may be formed into a layer 11 on a carrier which may have a release coating thereon or, optionally, onto a backing material 12, heated, and cooled to form the porous substrate. As indicated, optionally the blowing agent may be included in the mechanically frothed resinous base material 11 or may be in the inks applied to the base material in the subsequent design-producing step. In this embodiment, the blowing agent was included in the mechanically frothed foam. Inked design portions 12, 13, 14, 15, 16, 17, and 18, which extend clear through the thickness of the foam layer 11, were formed by applying differently colored inks having different melt viscosities, as previously described, in side-by-side relationship (butt-printed) thereto. Optionally, a clear, resinous top coat 19 may be applied to the structure followed by heating to fuse all the resinous material and decompose the blowing agent. In this embodiment, as in the previous one, the different melt viscosities of the inks applied to the porous substrate function to restrict foaming of the design elements in varying degrees, thus producing a multi-level embossed surface on the final product shown in FIG. 5.

Figure 6:
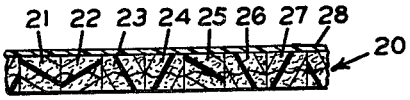
FIG. 6 is a cross-sectional view illustrating a portion of the surface covering made by the process of this invention and showing a porous, reinforced, non-woven polyester web which has been printed in a design with foamable resinous inks which have penetrated therethrough and a clear resinous top coat.
Figure 7:
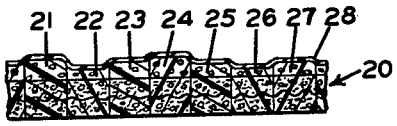
FIG. 7 is a cross-sectional view illustrating a portion of the surface covering having a multi-level wear surface which was made by the process of this invention from the structure shown in FIG. 6.

In the third embodiment of the invention, the porous substrate into which the inks are applied may comprise a non-woven fibrous web 20. In this embodiment, the resinous inks, as previously described, were applied to the porous substrate 20 to form design elements 21, 22, 23, 24, 25, 26, and 27 in the structure shown in FIG. 6 of the drawings. As shown in FIG. 7 of the drawings, the final product produced after application of a clear resinous top coat 28 and final heating to fuse the resinous material, and decompose the blowing agent, is a multi-level embossed structure resulting from, as in the previous embodiments, the variations in the restriction of foaming of a structure caused by the different melt viscosities of the inks used in forming the design.

Products which can be manufactured within the scope of this invention may include, but are not limited to, floor coverings, wall coverings, drapery and upholstery materials, furniture components, etc. Multi-level sheet products may be manufactured by the method of this invention without the use of chemical or mechanical embossing equipment and techniques, and the embossed areas thereon are in perfect registration with the printed pattern.

The following examples illustrate the three embodiments of the invention. All parts are by weight unless otherwise stated. All molecular weights (Mw) were determined by the Gel Permeation Chromatography method.

EXAMPLE I

Dryblend granules were prepared by mixing the following components together in a conventional Henschel dryblending apparatus through a heat history from ambient conditions to approximately 230° F. (110° C.) to ambient conditions.

| Ingredients | Parts by Weight |
|---|---|
| poly(vinyl chloride) resin | 100 |
| alkyl diarlyl phosphates (plasticizer) | 75 |
| octyl epoxy tallate (plasticizer) | 4 |
| zinc-barium octoates decyl phenyl phosphite (stabilizer) | 2 |
| *cell stabilizer | 1.5 |
| azodicarbonamide (blowing agent) | 4 |
| aluminum trihydrate (filler) | 150 |

*A methacrylate cell stabilizer designated "VS-103," commercially available from Air Products and Chemicals, Inc., Allentown, PA A base layer of the above composition was cast onto a release paper in a thickness of about 50 mils and then heated to about 350° F. for 3 minutes to sinter the dryblend mixture. The sintered mixture was then cooled.

Three resinous inks of the following formulations were prepared.

| Ingredients | Parts by Weight | | |
|---|---|---|---|
| poly(vinyl chloride) resin (dispersion grade) high Mw | 100 | | |
| poly(vinyl chloride) resin (dispersion grade) medium Mw | | 100 | |
| poly(vinyl chloride) resin (dispersion grade) low Mw | | | 100 |
| calcium carbonate (filler) | 40 | 40 | 40 |
| $C_7$—, $C_9$—, $C_{11}$ mixture, phthalate (plasticizer) | 30 | 30 | 30 |
| alkyl diarlyl phosphates (plasticizer) | 30 | 30 | 30 |
| octyl epoxy tallate (plasticizer) | 2 | 2 | 2 |
| zinc-barium octoates decyl phenyl phosphite (stabilizer) | 2 | 2 | 2 |
| *cell stabilizer | 0.5 | 0.5 | 0.5 |
| pigment | 5 | 5 | 5 |

*A methacrylate cell stabilizer designated "VS-103", commercially available from Air Products and Chemicals, Inc., Allentown, PA To the sintered porous dryblend layer, a design pattern was applied using the above inks, each of which was applied to a separate portion of the pattern in a side-by-side manner (butt printed). In this example, the penetration of each of the inks was essentially through 100% of the base layer. The structure was then heated to about 300° F. to gel the inks. About 10 mils of a top coat having the following formulation was applied to the structure.

| Ingredients | Parts by Weight |
|---|---|
| poly(vinyl chloride) resin (dispersion grade) | 100 |
| di(2-ethylhexyl)phthalate | 25 |
| 2,2,4 trimethyl-1,3 pentanediol diisobutyrate | 17 |
| dibutyl tin maleate | 2 |

The structure was then heated in a hot air impingement oven at 400° F. to produce fusion of the vinyl resin and decomposition of the blowing agent wherewith a multi-level embossed surface was realized. The embossed depth increased correspondingly to the increased melt viscosity of the applied ink. For the high melt viscosity ink, the depth was about 35 mils; for the medium melt viscosity ink, the depth was about 15 mils; and for the lower melt viscosity ink, the depth was 0 mils.

EXAMPLE II

A porous base layer was formed by mechanically frothing a resinous material having the following composition.

| Ingredients | Parts by Weight |
|---|---|
| poly(vinyl chloride) (dispersion grade) | 50 |
| poly(vinyl chloride) (blending grade) | 50 |
| di(2-ethylhexyl)phthalate | 65 |
| 2,2,4 trimethyl-1,3 pentanediol diisobutyrate ester | 8 |
| dibutyl tin maleate | 1 |
| polymethylsiloxane (surfactant) | 5 |
| calcium carbonate (filler) | 15 |
| azodicarbonamide (blowing agent) | 4 |

About 50 mils of the foamed material of the above formula was cast onto a paper and gelled at about 300° F. for 3 minutes and then cooled. The inks having the formulation given in Example I were then applied to the foamed layer and penetrated substantially through the entire thickness thereof. A top coat having the same formulation as that given in Example I was then applied in a thickness of about 10 mils, after which the structure was heated to about 400° F. to fuse the resinous material and decompose the blowing agent. This resulted in the finished product having a multi-level embossed surface.

EXAMPLE III

The base layer, in this example, was a porous, reinforced, non-woven polyester web of the type disclosed in U.S. Pat. No. 3,968,275. Inks having the same formula as given in Example I, but including four parts of the blowing agent, azodicarbonamide, per 100 parts of resin, was incorporated into each of the inks. The inks were applied to the porous base layer in a design and penetrated into the porous layer to a depth of about 40 mils. The structure was then heated to about 300° F. to gel the inks. To the gelled surface, 10 mils of the top coat having the formulation given in Example I was applied, and the structure was then heated in a hot air oven for about 3 minutes at 400° F. to fuse the resinous material and decompose the blowing agent. A multi-level embossed surface was thus achieved on the final product due primarily to the difference in the melt viscosities of the inks used in forming the design in the porous base layer.

What is claimed is:

1. A process for forming a decorative, cellular, resinous surface covering having a multi-level embossed wear surface, comprising (a) producing a printable porous substrate;

(b) pre-selecting a plurality of thermoplastic resins having different molecular weights which ultimately result in differences in their melt viscosities during a subsequent heating step;

(c) using said pre-selected resins as binders to form a plurality of thermoplastic resinous inks, at least one of said inks having a binder of a different molecular weight and therefore a different melt viscosity than that of another of said inks, the molecular weight differential between said resins being sufficient to produce a distinguishable embossed appearance in the final product by the effect of the melt viscosity difference;

(d) producing design areas in said porous substrate by applying the resinous inks to selected portions thereof in amounts and fluid viscosities predetermined to result in at least partial penetration through the thickness of the substrate at the points of application, said inks and said substrate comprising a composite structure which further includes a blowing agent; and (e) finally heating the composite structure to fuse the resin and decompose the blowing agent, whereby the differences in the melt viscosities of the pre-selected resins used in the inks affect the expansion of the ink-containing portions of the structure by the blowing agent in varying degrees, thus producing multi-level embossed cellular design areas on the final product.

2. The process according to claim 1 wherein the inks are plastisols of poly(vinyl chloride) resins which have molecular weights in the range of from about 50,000–200,000.

3. The process according to claim 1 wherein the minimum penetration of the inks is about 5% of the thickness of the porous substrate.

4. The process according to claim 1 wherein the inks penetrate through substantially the entire thickness of the porous substrate.

5. The process according to claim 1 wherein the molecular weight difference of the resins used in the inks is at least 7,000.

6. The process according to claim 1 wherein the ratio by weight of the blowing agent to resin in all of the printed areas is substantially uniform.

7. The process according to claim 1 wherein the amounts of solvent and plasticizer in the printed areas of the porous substrate are substantially uniform.

8. The process according to claim 1 wherein the blowing agent is azodicarbonamide.

9. The process according to claim 1 wherein the printable porous layer is composed of adhesively bonded inert particles and wherein the blowing agent is in the resinous inks applied thereto.

10. The process according to claim 1 wherein the printable porous substrate is a glass fiber mat and wherein the blowing agent is in the resinous inks applied thereto.

11. The process according to claim 1 wherein the printed porous substrate is a mechanically foamed resinous plastisol and the blowing agent is included therein.

12. The process according to claim 1 wherein the printed porous substrate is a mechanically foamed resinous plastisol and the blowing agent is in the inks applied thereto.

13. The process according to claim 1 including the application of a clear resinous top coat over the entire design-carrying surface of the printed porous substrate.

14. The process according to claim 1 wherein the inks are differently pigmented and are printed in side-by-side contact with each other.

15. The process according to claim 14 wherein the entire surface of the porous substrate is printed.

16. The process according to claim 1 wherein at least three of the inks applied to the porous substrate have binders of different melt viscosities.

17. The process according to claim 16 wherein the penetration of each of the inks having binders of different melt viscosities penetrate into the porous substrate to a different degree.

18. The process according to claim 1 wherein the printable porous substrate comprises a sintered layer of unfused resinous particles having a molecular weight range of about 50,000 to 200,000, and wherein the blowing agent is included in said dryblend layer, and the binders of at least some of the thermoplastic resinous inks applied thereto have melt viscosities which are different from that of the dryblend.

19. The process according to claim 18 wherein the melt viscosity of the binder in at least one of the inks is lower than that of the resinous dryblend.

20. The process according to claim 18 wherein the melt viscosity of the binder in at least one of the inks is higher than that of the resinous dryblend.

21. The process according to claim 18 wherein the melt viscosities of the binder in all of the inks are higher than that of the resinous dryblend.

22. The process according to claim 18 wherein the resinous particles are vinyl resin.

23. The process according to claim 22 wherein the vinyl resin is poly(vinyl chloride).

24. The product produced by the process of claim 1.

25. The product produced by the process of claim 9.

26. The product produced by the process of claim 10.

27. The product produced by the process of claim 11.

28. The product produced by the process of claim 18.

* * * * *